US008514166B2

(12) United States Patent
Chen et al.

(10) Patent No.: US 8,514,166 B2
(45) Date of Patent: Aug. 20, 2013

(54) LCD BACKLIGHT DIMMING, LCD/IMAGE SIGNAL COMPENSATION AND METHOD OF CONTROLLING AN LCD DISPLAY

(75) Inventors: Min Chen, Kowloon (HK); Huajun Peng, Tai Po (HK); Guoping Qiu, Fotan (HK); Chun Kit Hung, Kowloon (HK); Wei Zhang, Clear Water Bay (HK)

(73) Assignee: Hong Kong Applied Science and Technology Research Institute Company Limited, Shatin, New Territories, Hong Kong ( * ) Notice: Subject to any disclaimer, the term of this patent is extended or adjusted under 35 U.S.C. 154(b) by 1115 days.

(21) Appl. No.: 12/129,305

(22) Filed: May 29, 2008

(65) Prior Publication Data

US 2009/0295705 A1 Dec. 3, 2009

(51) Int. Cl.
*G09G 3/36* (2006.01)

(52) U.S. Cl.
USPC ..... 345/102; 345/204; 345/89; 345/690; 345/77; 345/590; 345/87; 345/88; 358/3.27; 358/80; 382/260; 382/274; 382/167; 382/275; 382/261; 382/169; 382/100; 348/678; 348/674; 348/687

(58) Field of Classification Search
USPC ..... 345/102, 150, 204, 690; 349/61; 382/169
See application file for complete search history.

(56) References Cited

U.S. PATENT DOCUMENTS

| | | | | |
|---|---|---|---|---|
| 5,717,422 | A | 2/1998 | Fergasson | |
| 7,053,881 | B2 | 5/2006 | Itoh | |
| 7,058,234 | B2 * | 6/2006 | Gindele et al. | 382/274 |
| 7,176,878 | B2 | 2/2007 | Lew et al. | |
| 2006/0274026 | A1 * | 12/2006 | Kerofsky | 345/102 |
| 2007/0092139 | A1 | 4/2007 | Daly | |
| 2009/0263037 | A1 | 10/2009 | Qiu | |
| 2009/0278786 | A1 * | 11/2009 | Chan et al. | 345/102 |
| 2009/0295705 | A1 * | 12/2009 | Chen et al. | 345/102 |
| 2010/0260396 | A1 * | 10/2010 | Brandt et al. | 382/131 |

* cited by examiner

*Primary Examiner* — Alexander S Beck
*Assistant Examiner* — Amen Bogale
(74) *Attorney, Agent, or Firm* — Wells St. John P.S.

(57) ABSTRACT

A method of reducing power consumption in a liquid crystal display illuminated by a backlight device includes dimming the backlight and adjusting the intensity of the image to compensate for the dimmed backlight. A dimming factor for the backlight is based on a clipping point determining from the pixel intensity distribution of the image signal. The intensity of the image is adjusted based on the dimming factor, wherein a first tone mapping function is used to adjust pixel intensities below an intensity threshold and a second tone mapping function is used to adjust pixel intensities above the intensity threshold.

16 Claims, 3 Drawing Sheets

LCD BACKLIGHT DIMMING, LCD/IMAGE SIGNAL COMPENSATION AND METHOD OF CONTROLLING AN LCD DISPLAY

BACKGROUND TO THE INVENTION

1. Field of the Invention

The current invention relates to liquid crystal display (LCD) devices that use a backlight source for illuminating a displayed image. More particularly, the invention relates to dimming of the backlight source to reduce power consumption, and also to adjustment of LCD transmittance values or image intensity values to compensate for dimming of the backlight.

2. Background Information

Various liquid crystal display (LCD) devices use a lighting source to either project an image onto a display surface such as a screen or have the light source positioned behind the LCD panel for direct viewing of an image produced on the LCD panel. A desire to reduce power consumption and improve the contrast of images displayed by LCD technology has led to various techniques for dynamically varying the light intensity of the light source and/or backlight of such LCD devices. Typically such variations in intensity of the light source results in a net dimming of the displayed image below the light intensity at which it was intended to be viewed.

In order to overcome this problem various compensation techniques have been proposed for backlight dimming. Examples of various techniques are disclosed in U.S. Pat. No. 5,717,422 to Fergasson, U.S. Pat. No. 7,053,881 to Itoh, U.S. Pat. No. 7,176,878 to Lew et al and US 2007/0092139. U.S. Pat. No. 5,717,422 proposes a backlight dimming factor based on average brightness of the image signal and simple expansion of LCD transmittance resulting in truncation of high brightness values. U.S. Pat. No. 7,053,881 proposes a backlight dimming factor based on average and peak intensity values of the image signal without LCD compensation resulting in perceived dimming of the displayed image. U.S. Pat. No. 7,176,878 proposes a linear amplitude boost of the LCD signal to compensate for backlight dimming, but does not discuss dimming methods. Finally, US 2007/0092139 proposes a backlight dimming factor based on peak intensity values of the image signal and linear expansion of LCD transmittance resulting in truncation of high brightness values.

SUMMARY OF THE INVENTION

Accordingly it is an objection of the present invention to provide a method of dimming the backlight source of an LCD display to reduce power consumption. It is a further object of the present invention to provide a method of adjustment of LCD transmittance values or image intensity values to compensate for dimming of the backlight There is disclosed herein a method for maintaining the perceived brightness viewed of an image on a dimmed backlight liquid crystal display, the method comprising steps of:

- dimming the backlight of a liquid crystal display by a dimming factor, and
- adjusting the pixel intensity distribution of image pixels based on the dimming factor, wherein a first tone mapping function is used to adjust pixel intensities below an intensity threshold and a second tone mapping function is used to adjust pixel intensities above the intensity threshold.

Preferably, the method of dimming the backlight of a liquid crystal display comprises steps of:

- determining a clipping point based on an pixel intensity distribution of a image signal,
- determining an dimming factor for the backlight based on the clipping point, and
- illuminating the backlight at the determined dimming factor.

Preferably, the clipping point is between the $60^{th}$ and $99^{th}$ percentiles of the pixel intensity distribution.

Preferably, the pixel intensity distribution is based on achromatic intensities of pixels in the image signal.

Preferably, the pixel intensity distribution is based on maximum value of Red, Green and Blue channel intensities of pixels in the image signal.

Preferably, the dimming factor is determined by an equation of the form $$BLdim = \left(\frac{CP}{Imax}\right)^{P},$$

wherein CP is the clipping point value, Imax is the max display intensity, the p is a constant than not less than one. The value of p is determined according to the LCD input-output characteristics, usually close to the gamma value of the display.

Preferably, the intensity threshold is less than Clipping point.

Preferably, the threshold is determined by an equation of the form $$|FP-CP|=|CP-I\max|,$$

where FP is the threshold, CP is the clipping point, Imax is the maximum display intensity of input image Preferably, one of the first and second tone mapping functions is non-linear.

Preferably, the second mapping function is a non-linear mapping function

Preferably, the non-linear second tone mapping function is generated by the pixel intensity distribution.

BRIEF DESCRIPTION OF THE DRAWINGS

An exemplary form of the present invention will now be described by way of example only and with reference to the accompanying drawings, in which.

DESCRIPTION OF THE EXEMPLARY EMBODIMENTS

Reference will now be made in detail to an exemplary embodiment of the present invention, an example of which is illustrated in the accompanying drawings A method of controlling the brightness of an LCD display device, such as an LCD television according to the invention includes dimming the backlight while at the same time increasing the transmittance of pixels in the LCD panel so as to maintain or improve on the original visual brightness characteristics of the displayed image. The invention comprises two aspects. The first aspect is an adaptive method of determining a backlight dimming factor based on brightness characteristics of the image, and in particular a brightness distribution analysis of the image signal. The second aspect of the invention is a method of adaptively adjusting the LCD transmittance, or equally the brightness value of the image signal, in order to compensate for a reduction in backlight brightness so that the brightness of the viewed image is substantially unchanged by backlight dimming. In the second aspect a compensation range is determined based on the backlight dimming factor. A Fidelity Point in the compensation range is found and different tone mapping algorithms are used for compensation range mapping above and below the Fidelity Point, which enhances brightness characteristics of the displayed image. When both aspects of the invention are used in a backlit LCD display device the invention results in lower power consumption without compromising viewed brightness of the displayed image.

A detailed explanation of the methods of the invention will now be given. In the description the terms brightness, luminance and intensity are interchangeable and refer to the relative amount of visible light that is emitted from an image, or each pixel of an image, as perceived by a person viewing the image. A brightness value for each pixel in an image is given by the Luma channel of the image signal. In an LCD display the Luma channel values determine the transmittance of the LCD pixels. The second aspect of the invention is illustrated with reference to LCD transmittance compensation, however this is not meant to limit the scope or functionality of the invention. The skilled addressee will appreciate that the invention can be practiced by direct compensation of an LCD driver signal or by compensation of Luma values in the image signal. The relationship between perceived brightness (B) of an image, backlight luminance (L) and LCD transmittance (T) is B=L×T.

Figure 1:
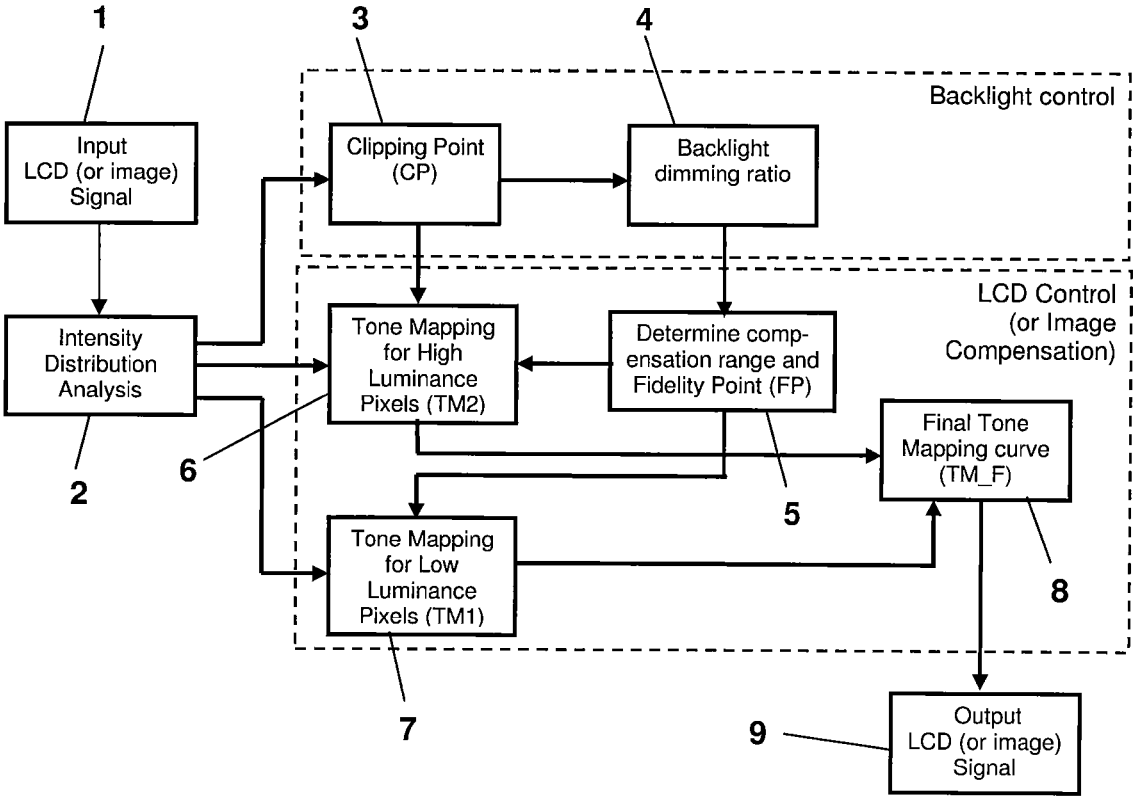
FIG. 1 is a block diagram illustrating backlight dimming and LCD/image signal compensation according to the invention.

The main steps in a preferred embodiment of the invention are illustrated in FIG. 1. An input LCD signal is subjected to an intensity distribution analysis 2 to find the signal intensity histogram 10. In the backlight control aspect of the invention a Clipping Point is determined in the intensity histogram and then a dimming factor is determined 4 based on the Clipping Point. In the LCD control (or image compensation) aspect of the invention the first step 5 is to determine a compensation range for the LCD (or image) signal and a Fidelity Point. Next separate tone mapping curves are determined 6, 7 for mapping the original LCD signal range to the compensated signal range above and below the Fidelity Point. The two tone mapping curves are combined 8 to form a final tone mapping curve which produces the output LCD signal 9.

Figure 2:
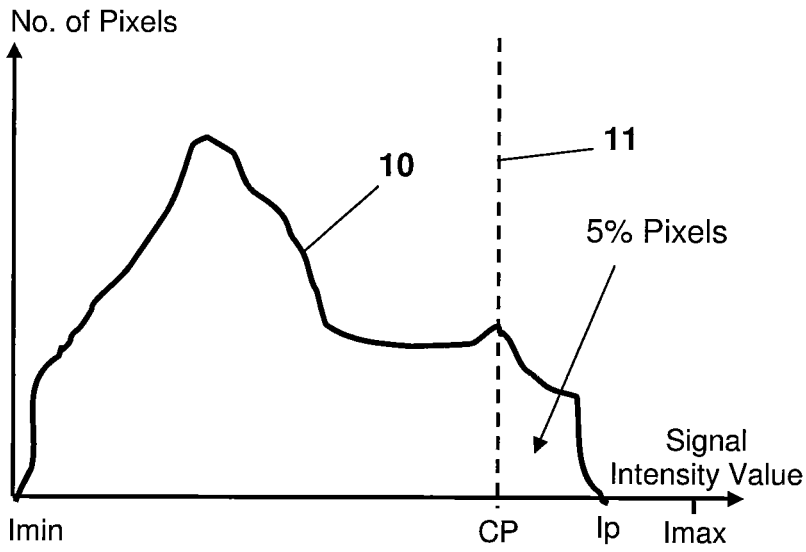
FIG. 2 is an intensity histogram of an LCD, or image, signal illustrating a clipping point for backlight dimming determination.

FIG. 2 illustrates a preferred method of finding the Clipping Point and backlight dimming factor utilising the brightness histogram 10 of the input LCD signal 1. In the image histogram illustrated in FIG. 2 the X, or horizontal, axis represents the original signal intensity values (e.g. image Y channel code values) from a minimum value (Imin) to a maximum value (Imax). The peak pixel intensity Ip of an image could be less or equal to Imax. In the illustrated embodiment Ip is less than Imax. The Y, or vertical, axis represents the number of pixels in the signal 1 having that intensity value. In a typical 8-bit signal the minimum intensity value is zero and the maximum intensity value, i.e. maximum brightness, is 255. These specific values are not essential to the invention and may be any value representative of a minimum and maximum brightness level.

For the purpose of explaining the invention, inventors introduce the concept of a Clipping Point 11. The Clipping Point 11 lies at the $95^{th}$ percentile of the intensity distribution range above which only 5% of pixels fall in the signal histogram 11. The value of 5% is found by the inventors to provide the best results, but is not essential to the invention. Typically, the Clipping Point will lie between the $60^{th}$ and 99th percentiles of the intensity distribution range, but higher or lower values may yield better or equally acceptable results depending on particular image types. An important characteristic of the Clipping Point 11 is that for a darker image the Clipping Point 11 will be a low value because the majority of pixels will have a low intensity values, and for a bright image the Clipping Point 11 will be a high value because more pixels will have higher intensity values. It should be apparent to the skilled of addressee that the position of the Clipping Point 11 will vary dynamically from frame to frame in a video image.

The backlight dimming factor (BLdim) is the dimmed backlight intensity as a function of clipping point value and is given by:

$$BLdim = \left(\frac{CP}{Imax}\right)^{P},$$

where CP is the clipping point value, Imax is the max display intensity, the p is a constant than not less than one. The value of p is determined according to the LCD input-output characteristics, usually close to the gamma value of the display.

In the preferred embodiment the backlight dimming factor BLdim is constrained between upper and lower limits. The maximum dimming factor, i.e. the minimum amount of dimming, is 85% and the minimum dimming factor, i.e. the maximum amount of dimming, 55%. If the backlight dimming factor is above the upper limit then the backlight dimming factor becomes the upper limit or 85%. If the dimming factor is below the lower limit then the dimming factor becomes lower limit or 55%. The limits can be represented by the following equation.

If BLdim>85% then BLdim=85%

If BLdim<55% then BLdim=55%

These upper and lower limits for the backlight dimming factor are not intended to the limiting on the scope or functionality of the invention. The 55 and 85% limits are those believed by the inventors to yield the best results in a method according to the invention. However, other limits may be found to provide equally acceptable or perhaps even better results. In a particular embodiment of the invention such limits may be adjustable by a viewer in order to satisfy subjective views on what values yield the best results.

In order to avoid an overall dimming in the perceived brightness of the image the LCD transmittance values, or image intensity values, must be adjusted before display of the image. However, this is not critical to the first aspect of the invention and the method of determining a backlight dimming factor can be used on its own within an LCD display without any compensation of the LCD or image signal to allow for the backlight dimming. The method of determining the backlight dimming level is dynamic and takes account of brightness characteristics of the image signal and thus is an improvement to backlight dimming methods used hitherto.

Figure 3:
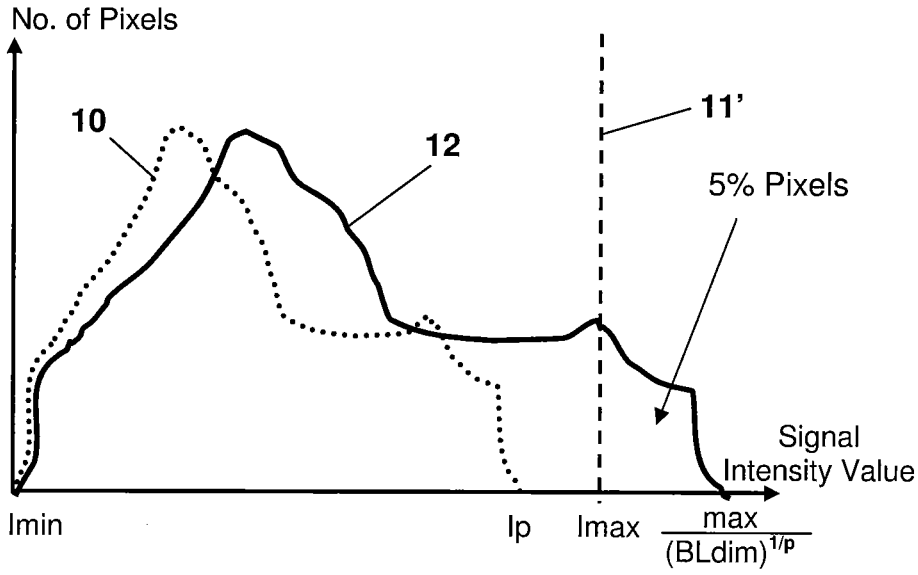
FIG. 3 is an intensity histogram of the signal illustrating signal intensity range expansion to compensate for backlight dimming, FIG. 4 graphically illustrates tone mapping between the original signal intensity range of FIG. 2 and the expanded intensity range of FIG. 3, and FIG. 5 graphically illustrates tone mapping according to the invention to ameliorate truncation of higher intensity values.

Compensation of the LCD signal input 1 is illustrated by the histogram 12 of FIG. 3 in which the image intensity range is expanded from Ip to Imax/(BLdim)$^{1/p}$. An alternative way to view the range expansion is that the image histogram 12 is stretched so that the Clipping Point 11 moves to Imax such that 5% of pixels in the image have a brightness of greater than Imax.

Figure 4:
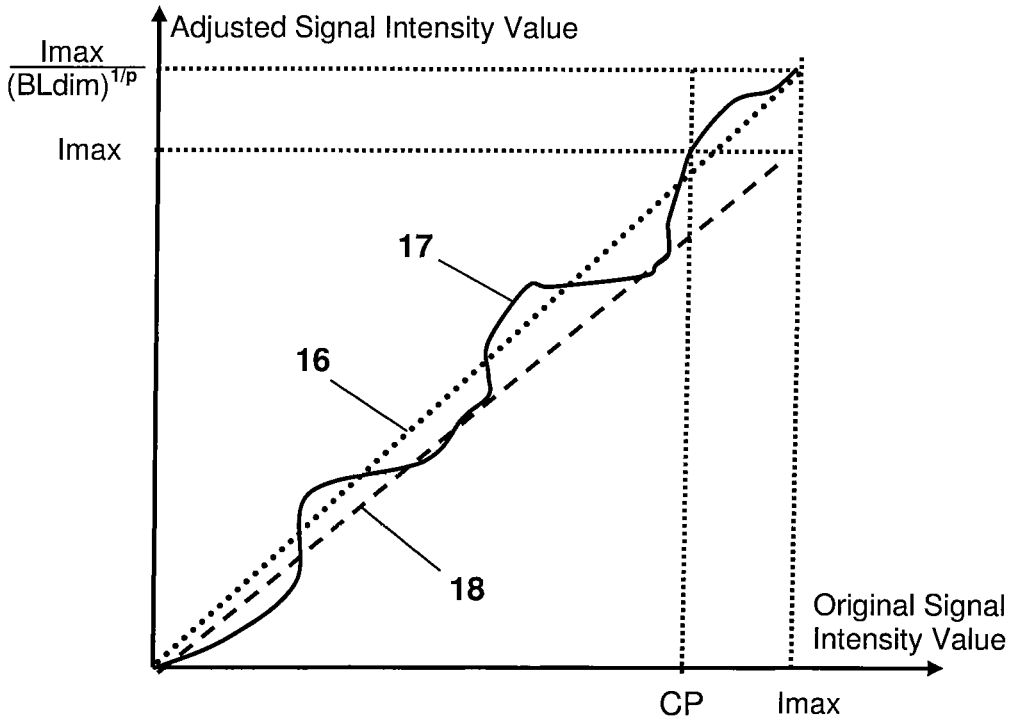

FIG. 4, which is given for illustrative purposes only, shows tone mapping for the compensation depicted in FIG. 3. The horizontal, X, axis represents the original intensity range of the LCD signal and the vertical, Y, axis the new, or target, intensity range for the signal. The dashed line 15 represents a one-to-one mapping where the original range is unchanged. The dotted line 16 represents a linear mapping from the original intensity range to the new intensity range and the solid line 17 represents a non-linear mapping from the original intensity range to the new intensity range. The type of mapping used in the invention is not critical and any linear or non-linear tone mapping algorithm known in the art can be used. It will be evidence to the skilled addressee that in practice it is not possible to expand the intensity range of the signal above the Imax value because intensity values above Imax will be truncated by the display hardware. In order to overcome this problem the invention introduces the concept of a Fidelity Point below which the intensity range of the signal is expanded by a first tone mapping function, thus increasing the transmittance of LCD crystals to compensate for backlight dimming. Above the Fidelity Point the intensity range of the signal is compressed using a second tone mapping function in order to constrain the image brightness values to within the maximum practical brightness value Imax.

Figure 5:
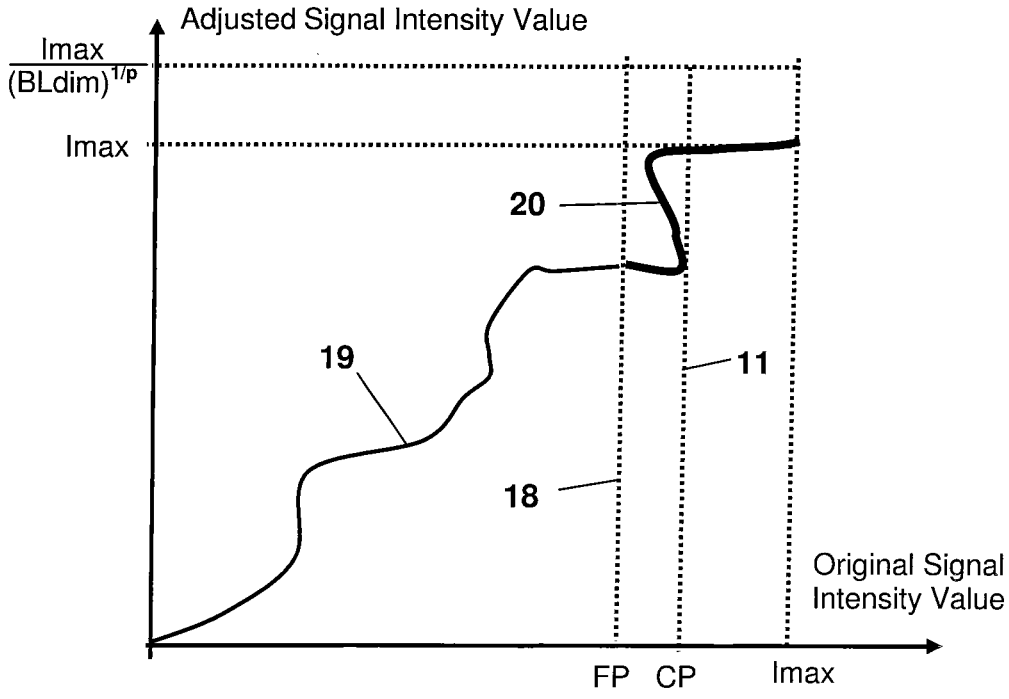

FIG. 5 illustrates a method of constraining the tone mapping above the Fidelity Point 18 to minimise truncation of higher intensity values. The Fidelity Point 18 is chosen at a suitably appropriate intensity value below the Clipping Point 11. In the preferred embodiment the Fidelity Point is chosen according to the equation |FP−CP|=|CP−Imax|, however this is not essential to the invention and the skilled addressee will realise that various methods of choosing a suitable Fidelity Point will yield suitable results. Below the Fidelity Point a first linear or non-linear tone mapping function is used to map the signal to the new intensity range along the same path that would be taken if the new maximum were Imax/(BLdim)$^{1/P}$. The first tone mapping function is illustrated by solid line 19. This ensures that below the Fidelity Point the LCD transmittance, or image signal brightness, increase to compensate for backlight dimming. Above the Fidelity Point however a different tone mapping function is used to constrain the brightness values so that the maximum brightness does not exceed Imax, the practical maximum value of brightness. The second tone mapping function is illustrated by line 20. In effect, the intensity range of the image signal is expanded below the Fidelity Point to compensate for backlight dimming and is constrain above the Fidelity Point to avoid truncation.

An example and exemplified embodiment of the invention have been described above. This is not intended to limit the scope of use of functionality of the invention. It should be appreciated that modifications and alternations obvious to those skilled in the art are not to be considered as beyond the scope of the present invention.

What we claim is:

1. A method of reducing power consumption in a liquid crystal display illuminated by a backlight device, the method comprising steps of:

determining a pixel intensity distribution for an image signal to be displayed on the liquid crystal display;

determining a clipping point at a predetermined percentile of the pixel intensity of the image signal, determining a dimming factor for the backlight based on the clipping point and illuminating the backlight according to the dimming factor, determining an intensity threshold at a suitably appropriate intensity value less than the clipping point, wherein the intensity threshold is determined by an equation of the form:

$$|FP-CP|=|CP-\text{Imax}|$$

wherein FP is the intensity threshold, CP is the clipping point, Imax is the maximum display intensity of input image; and adjusting the pixel intensity distribution of image pixels of an image based on the dimming factor, wherein a first tone mapping function is used to expand an intensity range of a first set of the image pixels of the image having pixel intensities below an intensity threshold and a second tone mapping function is used to compress an intensity range of a second set of the image pixels of the image having pixel intensities above the intensity threshold; wherein the first tone mapping function being different from the second tone mapping function.

2. The method of claim 1 wherein the clipping point is between the 60$^{th}$ and 99$^{th}$ percentiles of the pixel intensity distribution.

3. The method of claim 1 wherein the pixel intensity distribution is based on achromatic intensities of pixels in the image signal.

4. The method of claim 1 wherein the pixel intensity distribution is based on maximum value of Red, Green and Blue channel intensities of pixels in the image signal.

5. The method of claim 1 wherein the dimming factor is determined by an equation of the form $$BLdim = \left(\frac{CP}{Imax}\right)^{P},$$

wherein CP is the clipping point value, Imax is the max display intensity, the p is a constant not less than one; the value of p is determined according to the LCD input-output characteristics, usually close to the gamma value of the display.

6. The method of claim 1 wherein one of the first and second tone mapping functions is non-linear.

7. The method of claim 1 wherein the second mapping function is a non-linear mapping function.

8. The method of claim 7 wherein the non-linear second tone mapping function is generated by the pixel intensity distribution.

9. A method for maintaining the perceived brightness viewed of an image on a dimmed backlight liquid crystal display, the method comprising steps of:

dimming the backlight of a liquid crystal display by a dimming factor, which further comprises:

determining a clipping point based on a pixel intensity distribution of an image signal, determining an dimming factor for the backlight based on the clipping point, determining an intensity threshold at a suitably appropriate intensity value less than the clipping point, wherein the intensity threshold is determined by an equation of the form:

$$|FP-CP|=|CP-\text{Imax}|$$

wherein FP is the intensity threshold, CP is the clipping point, Imax is the maximum display intensity of input image; and illuminating the backlight at the determined dimming factor; and adjusting the pixel intensity distribution of image pixels of the image based on the dimming factor, wherein a first tone mapping function is used to expand an intensity range of a first set of the image pixels of the image having pixel intensities below an intensity threshold and a second tone mapping function is used to compress an intensity range of a second set of the image pixels of the image having pixel intensities above the intensity threshold; wherein the first tone mapping function being different from the second tone mapping function.

10. The method of claim 9 wherein the clipping point is between the $60^{th}$ and $99^{th}$ percentiles of the pixel intensity distribution.

11. The method of claim 9 wherein the pixel intensity distribution is based on achromatic intensities of pixels in the image signal.

12. The method of claim 9 wherein the pixel intensity distribution is based on maximum value of Red, Green and Blue channel intensities of pixels in the image signal.

13. The method of claim 9 wherein the dimming factor is determined by an equation of the form $$BLdim = \left(\frac{CP}{Imax}\right)^{P},$$

wherein CP is the clipping point value, Imax is the max display intensity, the p is a constant not less than one; the value of p is determined according to the LCD input-output characteristics, usually close to the gamma value of the display.

14. The method of claim 10 wherein one of the first and second tone mapping functions is non-linear.

15. The method of claim 10 wherein the second mapping function is a non-linear mapping function.

16. The method of claim 15 wherein the non-linear second tone mapping function is generated by the pixel intensity distribution.

* * * * *